US005653645A

United States Patent [19]

Baumann

[11] Patent Number: 5,653,645

[45] Date of Patent: Aug. 5, 1997

[54] GOLF CLUB PUTTER

[76] Inventor: Peter Baumann, 1351 Ridge Dr., Yreka, Calif. 96097

[21] Appl. No.: 491,781

[22] Filed: Jun. 19, 1995

[51] Int. Cl.[6] ..... A63B 53/02

[52] U.S. Cl. ..... 473/305; 473/306; 473/307; 473/308; 473/312

[58] Field of Search ..... 473/340, 305, 473/306, 307, 310, 312, 313, 308, 309, 311

[56] References Cited

U.S. PATENT DOCUMENTS 4,003,668 1/1977 Kelly, III et al. ..... 403/287

5,335,909 8/1994 Green, Jr. ..... 473/340

5,454,563 10/1995 Nagamoto et al. ..... 473/340

*Primary Examiner*—Vincent Millin

*Assistant Examiner*—Charles W. Anderson

*Attorney, Agent, or Firm*—Michael J. Striker

[57] ABSTRACT

A connecting device for a golf club putter includes a first cylindrical portion insertable into the opening of a putter head, a second cylindrical portion insertable into a hollow greater diameter and a shaft, and a flange located between the cylindrical portions and in assembled condition of the golf club putter abutting against the upper surface of the putter head and the lower surface of the greater diameter end of the shaft.

15 Claims, 2 Drawing Sheets

GOLF CLUB PUTTER

BACKGROUND OF THE INVENTION

The present invention relates generally to golf club putters which have a shaft and a head connected with one another.

Golf club putters are known in many various modifications. Usually, the shaft of the golf club putter has a diameter which reduces from one end to the other and is connected with the head so that the end having a smaller diameter is connected with the putter head while the end with the greater diameter is to be held by a user and can be provided with a grip.

In my U.S. Pat. No. 5,253,868 it has been proposed to provide a golf club putter in which a reversed shaft is utilized. In other words, the end of the shaft with the greater diameter is connected to the putter head, while the end of the shaft with the smaller diameter is provided with the grip. No devices have been suggested to make possible the use of the same putter head both with the conventional shaft and/or with the reversed shaft of my above mentioned U.S. Patent.

SUMMARY OF THE INVENTION

Accordingly, it is an object of the present invention to provide a golf putter with a connecting device, which is a further improvement of the existing golf club putters.

In keeping with these objects and with others which will become apparent hereinafter, one feature of the present invention resides, briefly stated, in golf club putter having a putter head, a putter shaft, and a connecting device which has a first cylindrical portion having a smaller diameter adapted to be inserted into an opening of the putter head, a second cylindrical portion having a greater diameter adapted to be inserted into a greater diameter end of the shaft, and a flange arranged between the cylindrical portions and extending radially beyond their outer surfaces.

When the golf putter is designed in accordance with the present invention, the portion with the smaller diameter of the connecting device is inserted into the opening of the putter head and can be reliably held there for example by glueing. Then shafts which conventionally were attached to the putter heads with their smaller diameter ends can be turned or reversed, and the greater diameter end of the conventional shaft can be fitted onto the second cylindrical portion of the connecting device. In the assembled condition, the flange provided between the cylindrical portions is located between the shaft and the putter head and abuts against the upper surface of the putter head and the lower surface of the shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
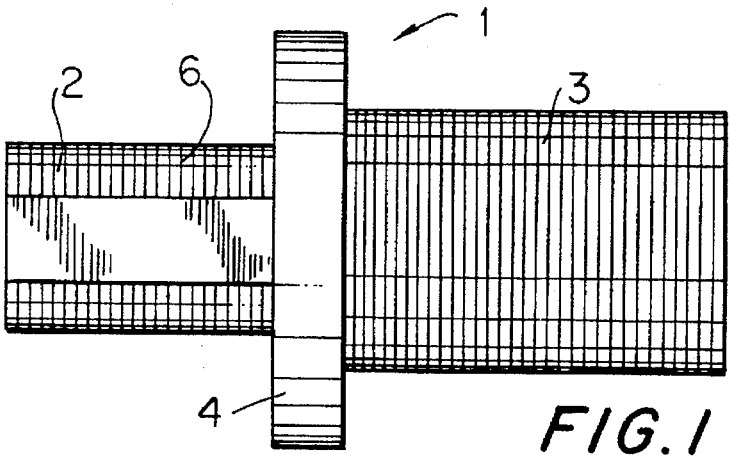
FIG. 1 is a side view showing a connecting device for golf club putter in accordance with the present invention.
Figure 2:
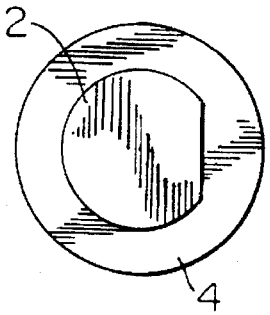
FIG. 2 is an end view of the inventive connecting device as seen from one end.
Figure 3:
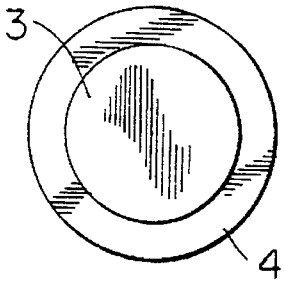
FIG. 3 is an end view of the inventive connecting device as seen from the other end.

FIG. 1 shows a connecting device for connecting a head of a golf club putter to a putter head. The connecting device is identified in the drawing with reference numeral 1 and has a first cylindrical portion 2 with a smaller diameter. The first cylindrical portion 2 has an outer diameter substantially corresponding to an inner diameter of an opening provided in a putter head, so that the cylindrical portion 2 can be received into the opening. The connecting device further has a second cylindrical portion 3 having a greater diameter adapted to be inserted into a greater diameter end of a shaft. A cylindrical flange 4 is provided between the cylindrical portion 2 and the cylindrical portion 3 and has an outer diameter which is greater than the diameters of both portions. In other words, the flange 4 projects radially outwardly beyond the outer peripheral surfaces of the portions 2 and 3.

In order to connect the shaft to the putter head, a cylindrical portion 2 is inserted into the opening of the putter head so that the flange 4 abuts against the upper surface of the putter head. Then, the shaft is fitted onto the the cylindrical portion 3 so that its lower surface abuts against the flange 4. The cylindrical portion 2 is connected to the putter head by glueing, for example by means of an adhesive such as an epoxy resin. The cylindrical portion 3 is connected with the shaft of the golf club putter also by glueing, for example by an adhesive, such as epoxy resin as well. The adhesive is first introduced into the opening of the putter head and then the cylindrical portion 2 is inserted into the opening filled with the resin. Since the opening in the putter head is formed as a blind opening, air must escape during insertion of the cylindrical portion into blind opening. For this purpose, the cylindrical portion 2 has a flattening 5 which reduces its diameter at one side. Therefore during insertion of the cylindrical portion 2 into the opening of the putter head filled with the adhesive, air can escape through a channel formed between the flattened side 5 and the inner diameter of the putter head opening.

The cylindrical portion 3, in contrast, is formed as a solid cylinder. During the connection, the adhesive is placed onto the cylindrical portion 3 and then the greater diameter end of the shaft is fitted onto the cylindrical portion. Since the shaft of the golf club putter is hollow, no additional passages for air escape air needed.

It is to be understood that the cylindrical portions 2 and 3 as well as flange 4 are coaxial with one another. The connecting device 1 is formed as one-piece member including the above mentioned parts 2, 3 and 4. In order to increase the adhesiveness, the outer surfaces of the portions 2 and 3 can be roughened, for example by providing any type of roughness including small grooves 6 which can be made during thinning of the surface of the cylindrical portions 2, 3.

Figure 4:
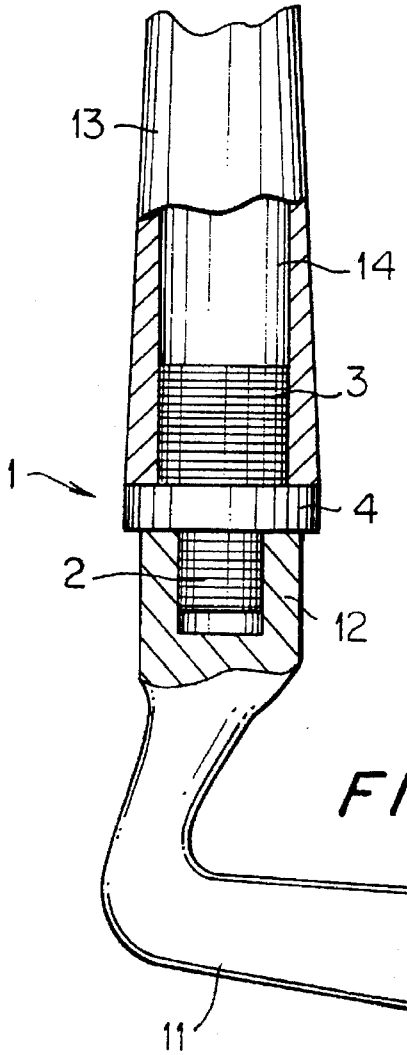
FIG. 4 is a view showing a golf club in accordance with the present invention.
Figure 5:
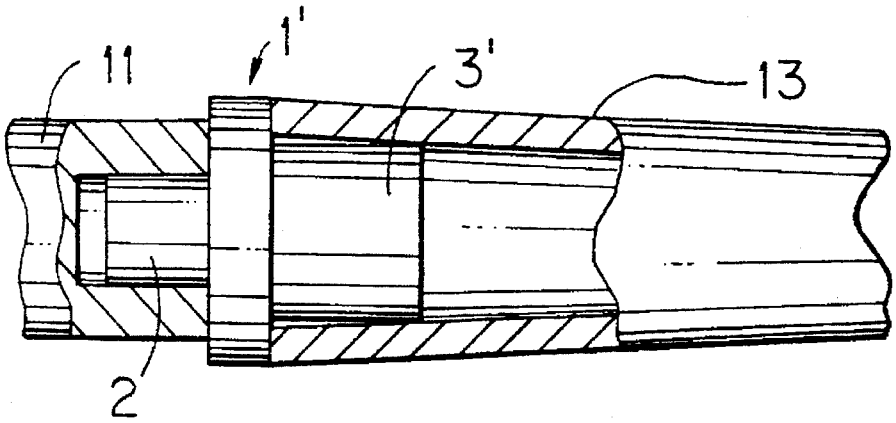
FIGS. 5 and 6 show a further modification of the invention.
Figure 6:
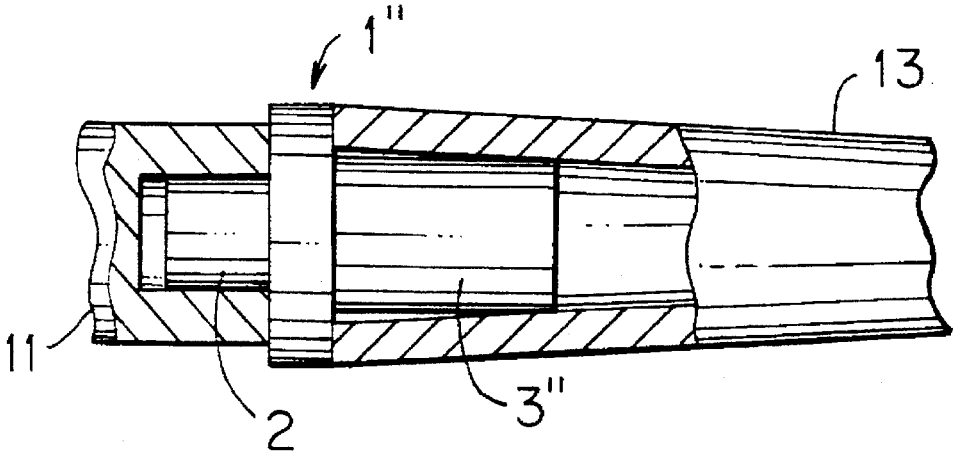

FIG. 4 shows a golf club putter formed in accordance with the present invention. The golf club putter has a head identified with reference numeral 11 and provided in its upper portion with a blind opening 12. A cylindrical portion 2 of the connecting device 1 is inserted into the blind opening 12 and connected with the putter head by adhesive. The golf club putter further has an inverted shaft 13 having an inner hollow 14 and fitted with its greater diameter end on the cylindrical portion 3 of the connecting device 1, to be also connected to this portion by adhesive. In assembled condition, the flange 4 is located between the putter head 11 and the shaft 13 so that the shaft abuts with its greater diameter end against the upper surface of the flange 4 while the putter head abuts against the lower surface of the flange 4.

With the connecting device in accordance with the present invention, it is possible to take a conventional golf club putter having the putter head and the shaft connected to it by its smaller diameter end, disconnect the shaft from the putter head, and connect the greater diameter end of the shaft with the putter head with the use of the inventive connecting device 1.

In accordance with a further embodiment of the invention, several connecting devices 1', 1" can be provided as a set. The connecting devices 1' and 1" differ from one another in that their cylindrical portions 3' and 3" have different lengths, and therefore the connecting devices have different weights. As a result a golfer, can select a corresponding connecting device to provide a heavier or a lighter putter head in the assembled condition of the golf club putter.

It will be understood that each of the elements described above, or two or more together, may also find a useful application in other types of constructions differing from the types described above.

While the invention has been illustrated and described as embodied in a connecting device for golf club putter and golf club putter provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A connecting device for a golf club putter, comprising a first cylindrical portion having a smaller diameter adapted to be inserted into an opening of a putter head; a second cylindrical portion having a greater diameter adapted to be inserted into a greater diameter end of a hollow shaft; and a flange provided between said first cylindrical portion and said second cylindrical portion and extending radially beyond the outer surfaces of said cylindrical portions.

2. A connecting device as defined in claim 1, wherein said first cylindrical portion has at least one side with a radius which is smaller than the radius of remaining sides of said first cylindrical portion so that when the first cylindrical portion is inserted into the opening of the putter head, an air escape passage remains between said at least one side of said first cylindrical portion and a wall of the opening of the putter head.

3. A connecting device as defined in claim 2, wherein said second cylindrical portion is formed as a solid cylinder.

4. A connecting device as defined in claim 1, wherein said first cylindrical portion, said second cylindrical portion, and said flange together form a one-piece integral element.

5. A connecting device as defined in claim 1, wherein said cylindrical portions have roughened outer cylindrical surfaces so as to increase adhesiveness for connecting said cylindrical portions by adhesive to the putter head and to the shaft correspondingly.

6. A connecting device as defined in claim 1, wherein said first cylindrical portion, said second cylindrical portion and said flange are coaxial with one another.

7. A set of connecting devices for a golf club putter, comprising at least two connecting devices each including a first cylindrical portion having a smaller diameter adapted to be inserted into an opening of a putter head, a second cylindrical portion having a greater diameter adapted to be inserted into a greater end of a hollow shaft, and a flange provided between said first cylindrical portion and said second cylindrical portion and extending radially beyond the outer surfaces of said cylindrical portions, said second cylindrical portion of one of said connecting devices being longer than said second cylindrical portion of the other of said connecting devices.

8. A golf club putter, comprising a putter head having a head opening and a head end surface; a shaft having a greater diameter end and a smaller diameter end and reducing from said greater diameter end to said smaller diameter end, said smaller diameter end of said shaft having a shaft opening and a shaft end surface facing said head end surface; and a connecting device for connecting said shaft to said putter head, said connecting device including a first cylindrical portion having a smaller diameter and inserted in said head opening of said putter head, a second cylindrical portion having a greater diameter and inserted in said shaft opening of said greater diameter end of said shaft, and a flange provided between said first cylindrical portion and said second cylindrical portion and extending radially beyond said cylindrical portions between said head end surface of said putter head and said shaft end surface of said shaft.

9. A golf club putter as defined in claim 8, wherein said first cylindrical portion has at least one side with a radius which is smaller than the radius of remaining sides of said first cylindrical portion so that when the first cylindrical portion is inserted into the opening of the putter head, an air escape passage remains between said at least one side of said first cylindrical portion and said wall of the opening of the putter head.

10. A golf club putter as defined in claim 8, wherein said second cylindrical portion is formed as a solid cylinder.

11. A golf club putter as defined in claim 8, wherein said first cylindrical portion, said second cylindrical portion, and said flange together form a one-piece integral element.

12. A golf club putter as defined in claim 8, wherein said cylindrical portions have roughened outer cylindrical surfaces so as to increase adhesiveness for connecting said cylindrical portions by adhesive to the putter head and to the shaft correspondingly.

13. A golf club putter as defined in claim 8, wherein said first cylindrical portion, said second cylindrical portion and said flange are coaxial with one another.

14. A golf club putter as defined in claim 8, wherein said flange has opposite surfaces which are in direct contact with said head end surface of said putter head and with said shaft end surface of said shaft.

15. A golf club putter, comprising a putter head having a head opening and a head end surface; a shaft having a greater diameter end and a smaller diameter end and reducing from said greater diameter end to said smaller diameter end, said smaller diameter end of said shaft having a shaft opening and a shaft end surface facing said head end surface; and a set of connecting devices each including a first cylindrical portion having a smaller diameter and adapted to be inserted in said head opening of said putter head, a second cylindrical portion having a greater diameter and adapted to be inserted in said shaft opening of said greater diameter end of said shaft, and a flange provided between said first cylindrical portion and said second cylindrical portion and extending radially beyond said cylindrical portions between said head end surface of said putter head and said shaft end surface of said shaft, said second cylindrical portion of one of said connecting devices being longer than said second cylindrical portion of the other of said connecting devices.

* * * * *